US008172508B2

(12) United States Patent
Mohamed et al.

(10) Patent No.: US 8,172,508 B2
(45) Date of Patent: May 8, 2012

(54) MULTIPLE AIRFOIL VANES

(75) Inventors: Ashraf Mohamed, Torrance, CA (US); David Strott, Denver, CO (US); Scott MacKenzie, San Pedro, CA (US)

(73) Assignee: Honeywell International Inc., Morristown, NJ (US)

( * ) Notice: Subject to any disclaimer, the term of this patent is extended or adjusted under 35 U.S.C. 154(b) by 31 days.

(21) Appl. No.: 12/819,218

(22) Filed: Jun. 20, 2010

(65) Prior Publication Data

US 2011/0312246 A1 Dec. 22, 2011

(51) Int. Cl.
*F01D 9/00* (2006.01)

(52) U.S. Cl. ..... 415/115; 415/164; 415/165; 415/191; 415/186

(58) Field of Classification Search ..... 415/115, 415/160, 163, 164, 166, 186, 191, 211.2, 415/165

See application file for complete search history.

(56) References Cited

U.S. PATENT DOCUMENTS

| | | | | |
|---|---|---|---|---|
| 3,162,421 | A * | 12/1964 | Schwarz | 415/166 |
| 3,356,289 | A * | 12/1967 | Plotkowiak | 415/149.2 |
| 3,756,739 | A * | 9/1973 | Boussuges | 415/161 |
| 3,957,392 | A * | 5/1976 | Blackburn | 415/146 |
| 4,752,182 | A * | 6/1988 | Zaehring et al. | 415/12 |
| 6,050,775 | A | 4/2000 | Erdmann et al. | |
| 6,709,232 | B1 | 3/2004 | Vogiatzis | |
| 6,948,907 | B2 | 9/2005 | Vogiatzis et al. | |
| 7,147,433 | B2 | 12/2006 | Ghizawi | |
| 7,255,530 | B2 | 8/2007 | Vogiatzis et al. | |
| 2007/0107426 | A1 | 5/2007 | Castan | |
| 2008/0260528 | A1 | 10/2008 | Weber et al. | |

FOREIGN PATENT DOCUMENTS

EP 1790830 A1 5/2007

* cited by examiner

*Primary Examiner* — Ninh H Nguyen
(74) *Attorney, Agent, or Firm* — Brian Pangrle

(57) ABSTRACT

A vane for a turbine assembly of a turbocharger includes a first airfoil that includes a length between a leading edge and a trailing edge, a second airfoil that includes a length between a leading edge and a trailing edge where the length of the first airfoil optionally differs from the length of the second airfoil, and one or more intra-vane throats defined at least in part by the first airfoil and the second airfoil. Various other examples of devices, assemblies, systems, methods, etc., are also disclosed.

23 Claims, 8 Drawing Sheets

MULTIPLE AIRFOIL VANES

TECHNICAL FIELD

Subject matter disclosed herein relates generally to turbomachinery for internal combustion engines and, in particular, vanes for directing exhaust to a turbine wheel.

BACKGROUND

Variable nozzle turbine assemblies act to accelerate exhaust exiting a volute (or volutes) and to direct exhaust more evenly to a turbine wheel. Wear and durability of a variable nozzle turbine assembly that relies on pivotable vanes depends heavily on vane design, especially design of a vane's airfoil. As exhaust flows through throats defined by adjacent vanes, the vanes experience torque. Further, torque typically varies with respect to vane position and exhaust condition. Airfoil design also affects wake and shock wave formation. Shock waves impact various components of a variable nozzle turbine assembly. Shock waves and wake generated by exhaust flowing past airfoils have a direct impact on turbine wheel performance and integrity.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with the accompanying drawings where.

DETAILED DESCRIPTION

Vane design in a variable nozzle turbine relates to performance, wear and durability of a turbocharger. Vane airfoil characteristics determine, in part, torque generated about a vane's control axle as well as shock and wake created, which impacts turbine wheel performance and reliability. As to vane airfoil characteristics, certain characteristics benefit torque reduction and certain characteristics benefit wake reduction.

As described herein, in various examples, vanes are presented that have beneficial characteristics. In particular, various vanes presented herein include multiple airfoils. Such multiple airfoil vanes allow for interactions between airfoils, which enable smoother flows that can increase efficiency while minimizing shock/wake. For example, it is desirable to reduce vane trailing edge wake and shock intensity of rotor stator interaction thereby reducing unsteady turbine blade loading while meeting any required torque characteristics (e.g., no directional reversal and lower actuation force). Vanes with multiple and differently shaped airfoils also enable torque of a vane to be tuned.

Figure 1:
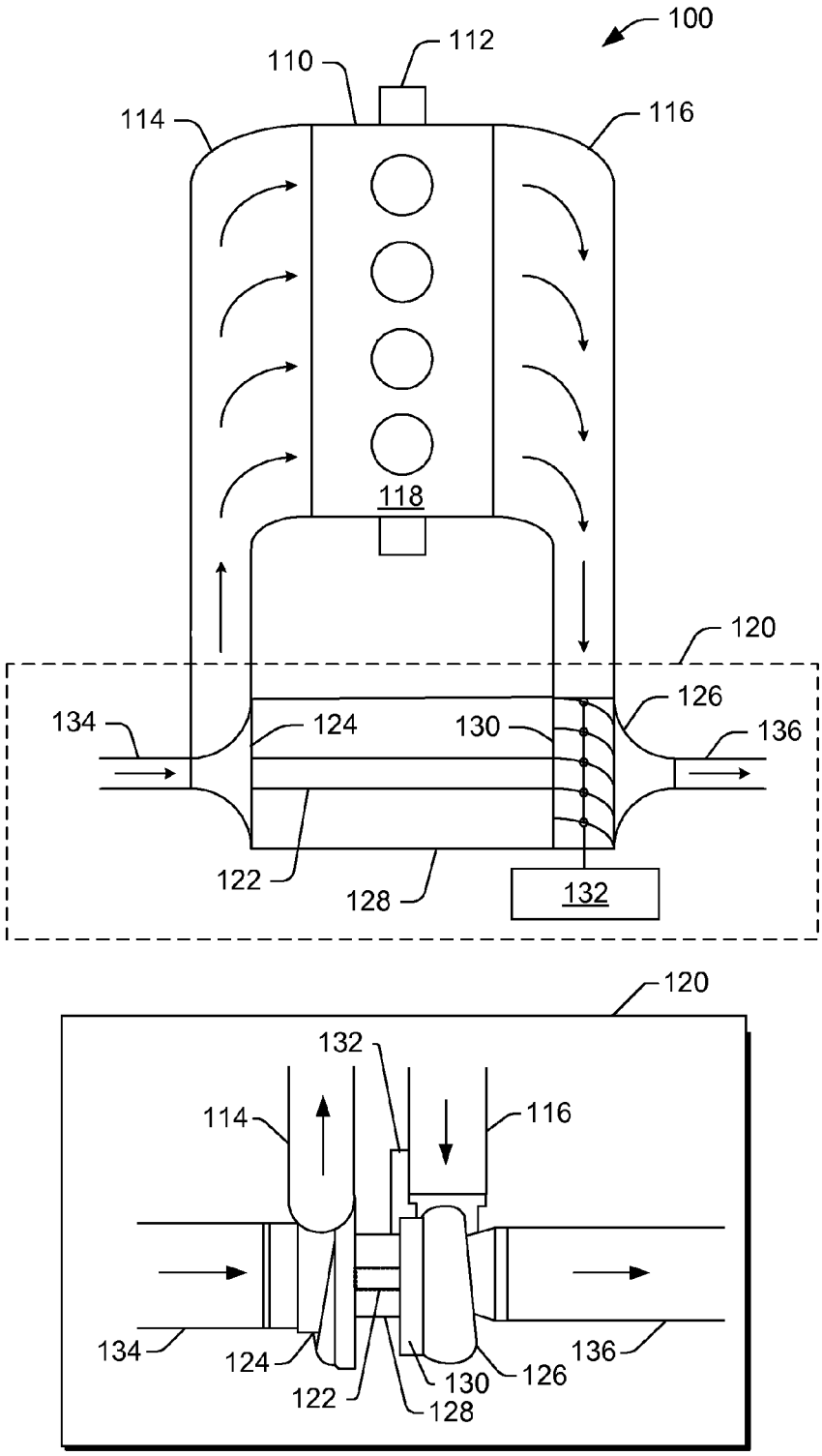
FIG. 1 is a diagram of a turbocharger and an internal combustion engine.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112. As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components.

Such a turbocharger may include one or more variable geometry units, which may use multiple adjustable vanes, an adjustable diffuser section, a wastegate or other features to control the flow of exhaust (e.g., Variable geometry turbine) or to control the flow of intake air (e.g., variable geometry compressor). In FIG. 1, the turbocharger 120 further includes a variable geometry mechanism 130 and an actuator or controller 132. The variable geometry mechanism 130 provides for adjusting or altering flow of exhaust to the turbine 126.

Adjustable vanes positioned at an inlet to a turbine can operate to control flow of exhaust to the turbine. For example, GARRETT® VNT® turbochargers adjust the exhaust flow at the inlet of a turbine in order to optimize turbine power with the required load. Movement of vanes towards a closed position typically directs exhaust flow more tangentially to the turbine, which, in turn, imparts more energy to the turbine and, consequently, increases compressor boost. Conversely, movement of vanes towards an open position typically directs exhaust flow in more radially to the turbine, which, in turn, reduces energy to the turbine and, consequently, decreases compressor boost. Closing vanes also restrict the passage there through which creates an increased pressure differential across the turbine, which in turn imparts more energy on the turbine. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, a turbocharger may employ wastegate technology as an alternative or in addition to aforementioned variable geometry technologies.

Figure 2:
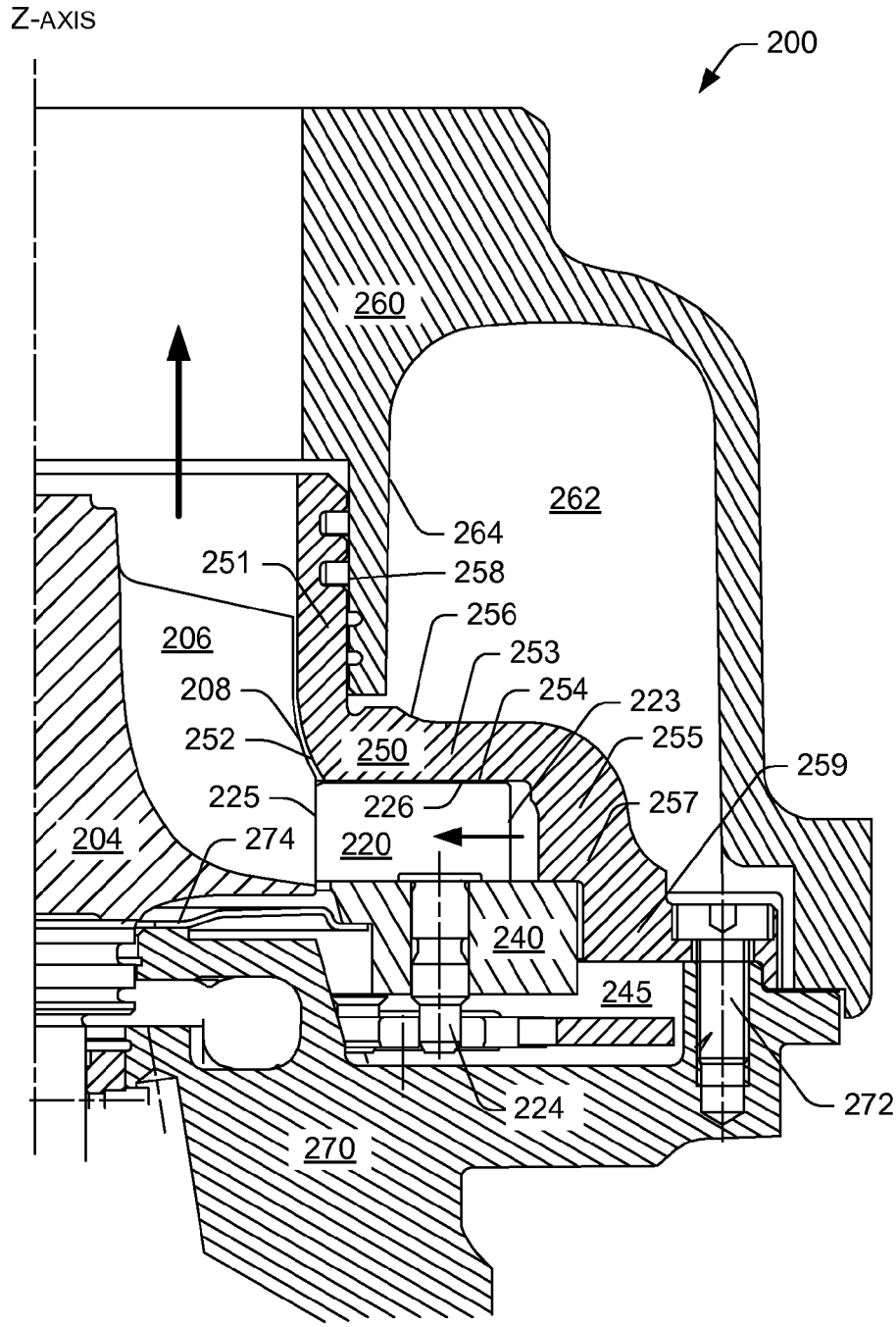
FIG. 2 is a cross-sectional view of a turbine assembly that includes adjustable vanes to direct exhaust to a turbine wheel.

FIG. 2 shows a cross-sectional view of a turbine assembly 200 having a turbine wheel 204 and vanes (see, e.g., the vane 220) associated with a variable geometry mechanism. The turbine assembly 200 may be part of a turbocharger such as the turbocharger 120 of FIG. 1. In the example of FIG. 2, the turbine wheel 204 includes a plurality of blades (see, e.g., the blade 206) that extend primarily in a radial direction outward from the z-axis. The blade 206, which is representative of other blades, has an outer edge 208 where any point thereon can be defined in an r, Θ, z coordinate system (i.e., a cylindrical coordinate system). The outer edge 208 defines an exducer portion (where exhaust exits) and an inducer portion (where exhaust enters). The vane 220 directs exhaust to the inducer portion of the turbine wheel 204.

In the example of FIG. 2, the vane 220 is positioned on an axle or post 224, which is set in a vane base 240, which may be part of a variable geometry mechanism. As shown, the post 224 is aligned substantially parallel with the z-axis of the turbine wheel 204 and includes an upper surface 226. While the post 224 is shown as not extending beyond the upper surface 226, in other examples, a post may be flush with the upper surface 226 or extend above the upper surface 226 (e.g., received by a receptacle of the housing 250, etc.).

With respect to adjustments, a variable geometry mechanism can provide for rotatable adjustment of the vane 220 along with other vanes to alter exhaust flow to the blades of the turbine wheel 204. In general, an adjustment adjusts an entire vane and typically all of the vanes where adjustment of any vane also changes the shape of the flow space between adjacent vanes (e.g., vane throats or nozzles). In FIG. 2, arrows indicate general direction of exhaust flow from an inlet end 223 to an outlet end 225 of the vane 220. As mentioned above, adjustments toward "open" direct exhaust flow more radially to the turbine wheel 204; whereas, adjustments toward "closed" direct exhaust flow more tangentially to the turbine wheel 204.

The turbine assembly 200 is a particular example; noting that various vanes described herein may be implemented in other types of turbine assemblies. In the example of FIG. 2, the assembly 200 has an insert 250 that includes, from the top down (i.e., along the z-axis): a substantially cylindrical or tubular portion 251; a substantially planar, annular portion 253; one or more extensions 255; a leg or step portion 257; and a base portion 259. The base portion 259 extends to an opening configured for receipt of a bolt 272 to attach the insert 250 to a center housing 270. As shown in FIG. 2, a turbine housing 260 seats over the insert 250 and forms a volute 262, defined at least in part by a volute side surface 264 of the housing 260 and a volute side surface 256 of the inset 250. The volute 262 receives exhaust (e.g., from one or more cylinders of an engine) and directs the exhaust to the vanes.

During sharp operational transients, forces acting on a vane may affect operability or longevity. Such forces may be from flow of exhaust past surfaces of a vane, pressure differentials (e.g., between a command space 245 and vane space), or one or more other factors.

The controller 132 of FIG. 1 may be in communication with an engine control unit (ECU) that includes a processor and memory. The ECU may provide the controller 132 with any of a variety of information (e.g., instructions, throttle, engine speed, etc.) and the controller 132 may likewise provide the ECU with information (e.g., vane position, etc.). The controller 132 may be programmed by the ECU or by other techniques. The controller 132 may include a processor and memory, optionally as a single integrated circuit (e.g., a chip) or as more than one integrated circuit (e.g., a chipset).

Figure 3:
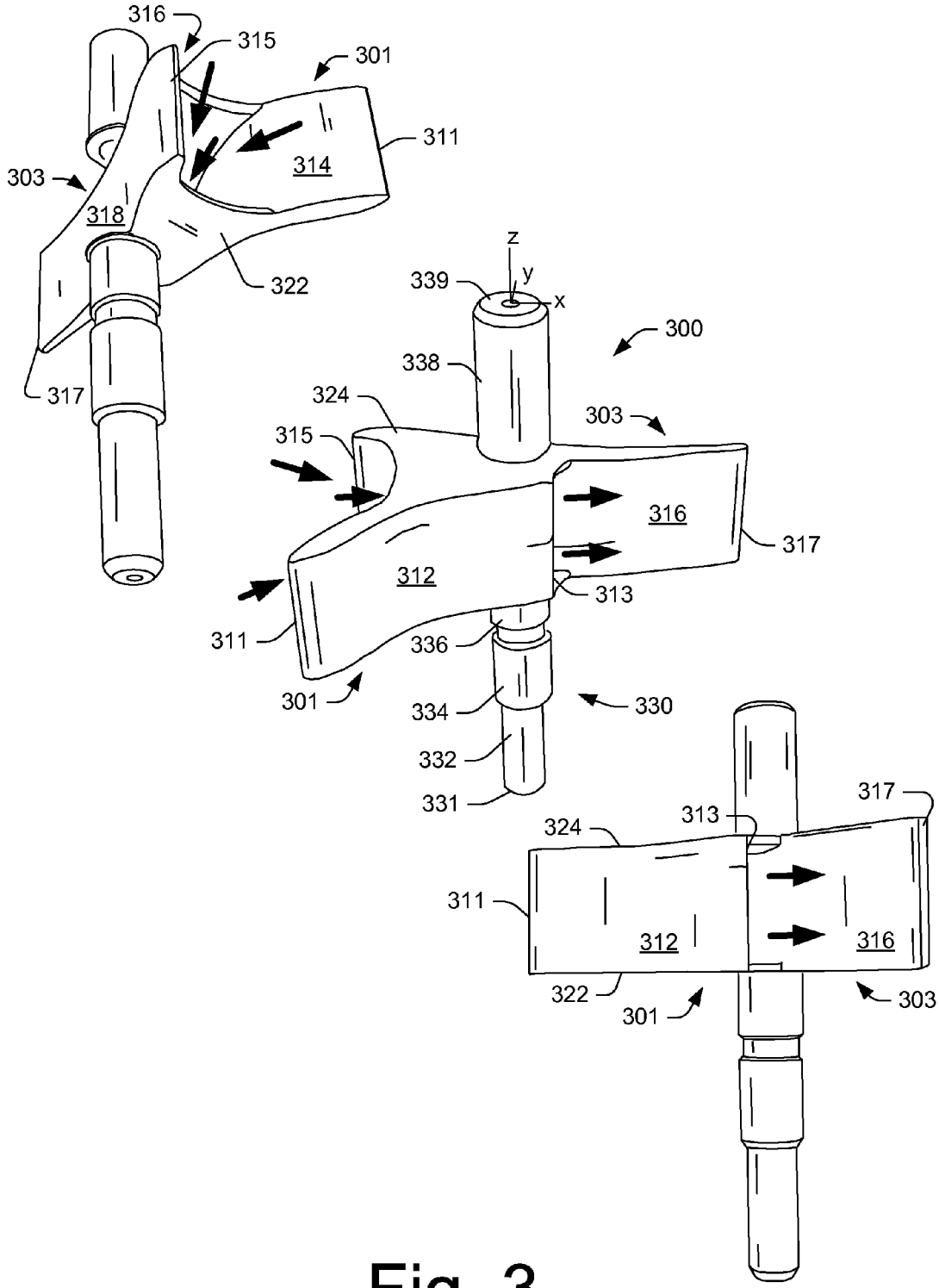
FIG. 3 is a series of perspective views of a vane with multiple airfoils.

As mentioned, various vanes presented herein include multiple airfoils that can enhance performance, particularly with respect to torque and wake. FIG. 3 shows an example of a vane 300 with multiple airfoils 301 and 303 along with a coordinate system (x, y, z). In the example of FIG. 3, the airfoil 301 is shorter than the airfoil 303 (e.g., along the x-axis). The airfoil 301 has an outer facing airfoil surface 312 and an inner facing airfoil surface 314 where the surfaces 312 and 314 are disposed between a leading edge 311, a trailing edge 313, a base surface 322 and a hub surface 324. The airfoil 303 has an inner facing airfoil surface 316 and an outer facing airfoil surface 318 where the surfaces 316 and 318 are disposed between a leading edge 315, a trailing edge 317, a base surface 322 and a hub surface 324. Accordingly, in the example of FIG. 3, the two airfoils 301 and 303 share a common base surface 322 and a common hub surface 324. The airfoil surfaces 312, 314, 316 and 318 can be described with respect to the coordinate system and optionally with respect to projections, for example, in two of the three dimensions.

The vane 300 further includes a post 330 that extends axially downwardly (z-axis) from the base surface 322 to a base end 331 and axially upwardly from the hub surface 324 to a hub end 339. The post 330 includes various cylindrical surfaces 332, 334, 336 and 338, which may optionally be defined by a radius or radii about the z-axis. As mentioned, a vane may or may not have both an upwardly extending post portion and a downwardly extending post portion. Further, other mechanisms exist for adjusting a vane or vanes in a variable nozzle turbine assembly.

Arrows indicate approximate directions of exhaust flow through a throat defined by the airfoil 301 and 303. As shown, exhaust enters the throat between the leading edges 311 and 315 and exits the throat between the trailing edge 313 of the airfoil 301 and a line or curve along the inner facing surface 316 of the airfoil 303 (e.g., consider a projection of the vane 300 in the x,z-plane).

In the example of FIG. 3, the vane 300 includes a first airfoil 301 that includes a length between a leading edge 311 and a trailing edge 313; a second airfoil 303 that includes a length between a leading edge 315 and a trailing edge 317 (e.g., where the length of the first airfoil may differ from the length of the second airfoil); and an intra-vane throat defined at least in part by the first airfoil 301 and the second airfoil 303.

Figure 4:
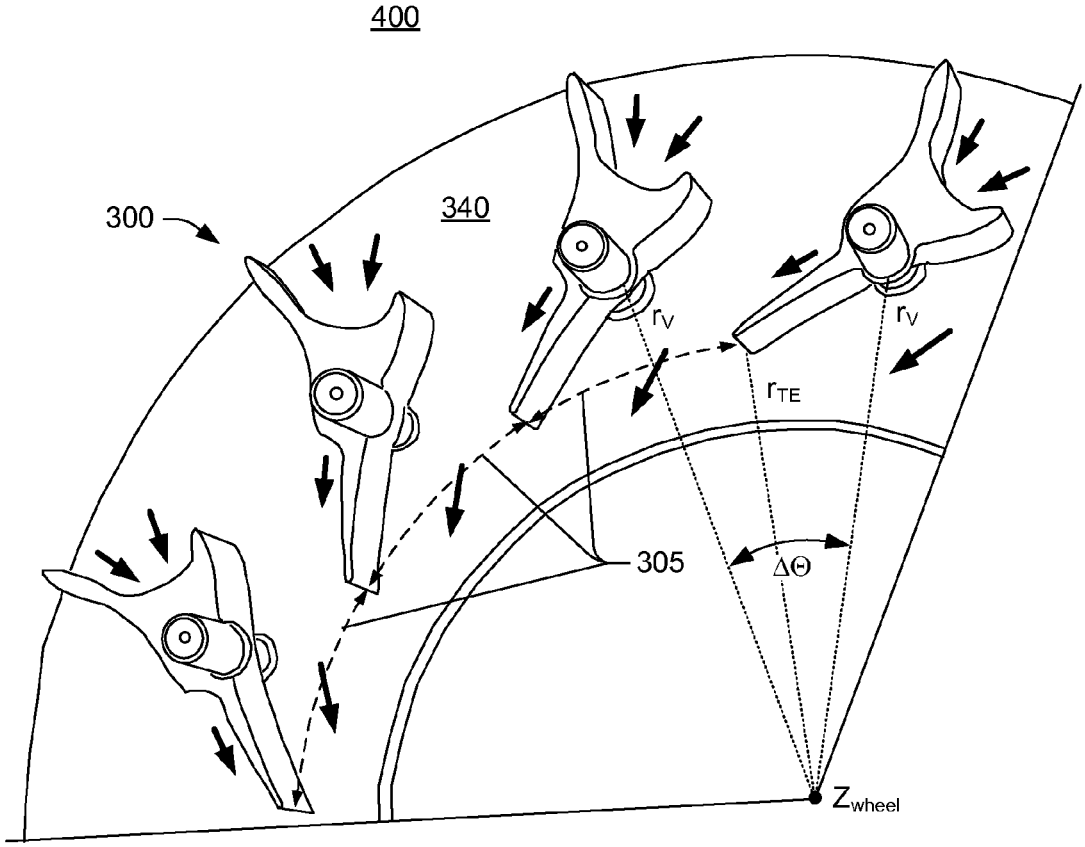
FIG. 4 is a perspective view of a portion of a variable nozzle turbine assembly that includes a plurality of multiple airfoil vanes.

FIG. 4 shows an example of a portion 400 of a variable nozzle turbine assembly. The portion 400 includes four vanes such as the vane 300. Trailing edges of a longer airfoil define a series of vane-to-vane throats 305. Accordingly, in the example of FIG. 4, the variable nozzle turbine assembly includes one intra-vane throat per vane and one inter-vane throat per vane (e.g., as defined between adjacent vanes). The portion 400 is shown with respect to a cylindrical coordinate system (r, Θ, Z) where the Z-axis is aligned with a rotational axis of a turbine wheel ($Z_{wheel}$). Each of the vanes 300 is set at a vane radius $r_V$ and the vanes are separated at an angle ΔΘ. Upon adjustment of the vanes, a trailing edge radius $r_{TE}$ of each vane 300 changes. Accordingly, each vane can be described with respect to a Cartesian coordinate system (x, y, z) and vanes in a variable nozzle turbine assembly can be further described with respect to a cylindrical coordinate system (r, Θ, Z).

As described herein, a variable nozzle turbine assembly can include a plurality of vanes that define inter-vane throats where each vane includes a first airfoil that includes a length between a leading edge and a trailing edge; a second airfoil that includes a length between a leading edge and a trailing edge (e.g., where the length of the first airfoil optionally differs from the length of the second airfoil); and one or more intra-vane throats defined at least in part by the first airfoil and the second airfoil. In such an assembly, the length of the second airfoil may exceed the length of the first airfoil and, accordingly, trailing edges of the second airfoil may define at least in part the inter-vane throats. In such an assembly, pivotable adjustment of the plurality of vanes alters shape of the inter-vane throats. As shown in the example of FIG. 4, each vane includes an axle set in an annular ring.

As described herein, where multiple airfoil vanes enhance flow dynamics, a turbine wheel may be provided with characteristics that differ from a conventional turbine wheel (e.g., consider a conventional wheel designed to withstand shock). For example, a turbine wheel may be provided that has thinner blades, which can improve efficiency. In an example, an assembly includes a turbine wheel with blade thickness less than a conventional turbine wheel where the thinner blades are acceptable due to improved shock/wake of multiple airfoil vanes. As mentioned, thinner blades allow a turbine wheel to be more efficient than conventional variable nozzle turbine wheels (e.g., consider the blade 206 of FIG. 2 with a thickness less than that of a conventional wheel).

Figure 5:
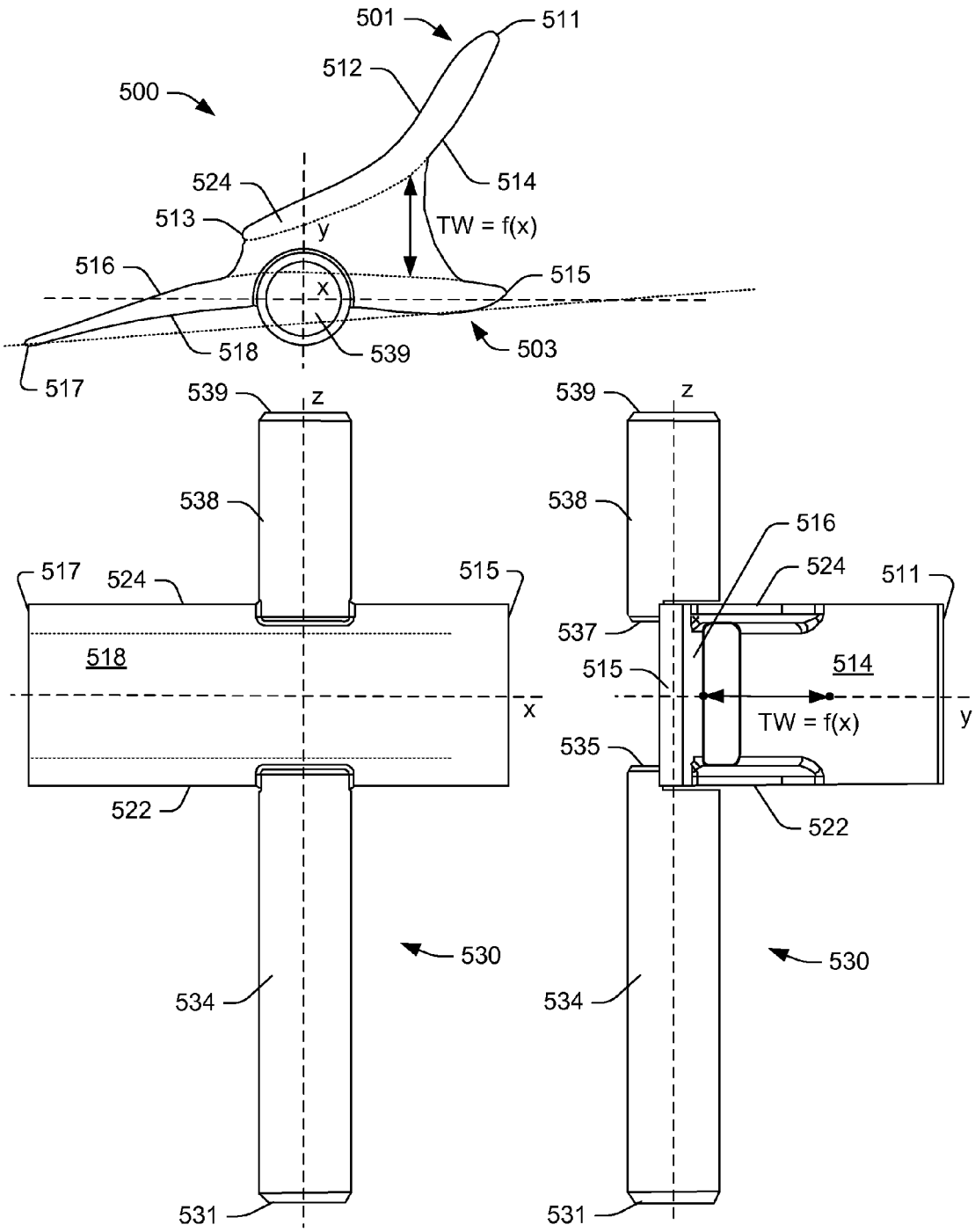
FIG. 5 is a series of views of a vane that includes multiple airfoils.

FIG. 5 shows an example of a vane 500 with multiple airfoils in a series of planar views (i.e., projections in a Cartesian coordinate x, y, z system). The vane 500 includes a post 530 that extends from a base end 531 to a hub end 539 with a lower portion 534 and an upper portion 538. In a x,y-projection, the following features of the airfoils 501 and 503 are shown: leading edges 511 and 515, trailing edges 513 and 517, hub end surface 524 and post end 539. In the x,y-projection, the intra-vane throat width (TW), as defined by the two airfoils 501 and 503 can be defined as a function of y with respect to x (e.g., TW=f(x)); noting that, in various examples, one or both inner airfoil surfaces 514 and 516 may vary with respect to z (e.g., TW=f(x, z)). In the other two projections, the airfoil surfaces 514, 516 and 518 are shown. In the y,z-projection, the intra-vane throat outlet is shown as a substantially rectangular shape having an aspect ratio of about 4:1 (i.e., longer along the z-axis than the y-axis). The inlet of the intra-vane throat is defined between the leading edges 511 and 515 and has an aspect ratio of about 1:1.5 (i.e., longer along the y-axis that the z-axis). Accordingly, the throat narrows along its y-dimension from the leading edges 511 and 515 to the trailing edge 513.

The y,z-projection also exhibits edges 535 of the lower post portion 534 and the upper post portion 538, respectively, as well as a base end surface 522. The position of the airfoils 501 and 503 with respect to the post portions 534 and 538 allows for essentially unimpeded flow along the outer facing surface 518 of the airfoil 503. In the x,y-projection, a line drawn between a peak point near the leading edge 515 and the trailing edge 517 shows concavity of the airfoil surface 518; noting that the outer facing airfoil surface of the airfoil 501 is also concave. Further, the inner facing airfoil surfaces 514 and 516 both have convexity in the x,y-projection. As described herein, an airfoil may have convexity, concavity or a combination of both in a z,y-projection (e.g., to shape the intra-vane throat exit, the intra-vane throat entrance or points therebetween).

In the example of FIG. 5, the vane 500 includes a first airfoil 501 that includes a length between a leading edge 511 and a trailing edge 513; a second airfoil 503 that includes a length between a leading edge 515 and a trailing edge 517 (e.g., where the length of the first airfoil may differ from the length of the second airfoil); and an intra-vane throat defined at least in part by the first airfoil 501 and the second airfoil 503. As shown in FIG. 5, the vane 500 includes a post with a post axis. As described herein, one of the airfoils may be offset from the post axis while the other airfoil may optionally be centered on the post axis.

Figure 6:
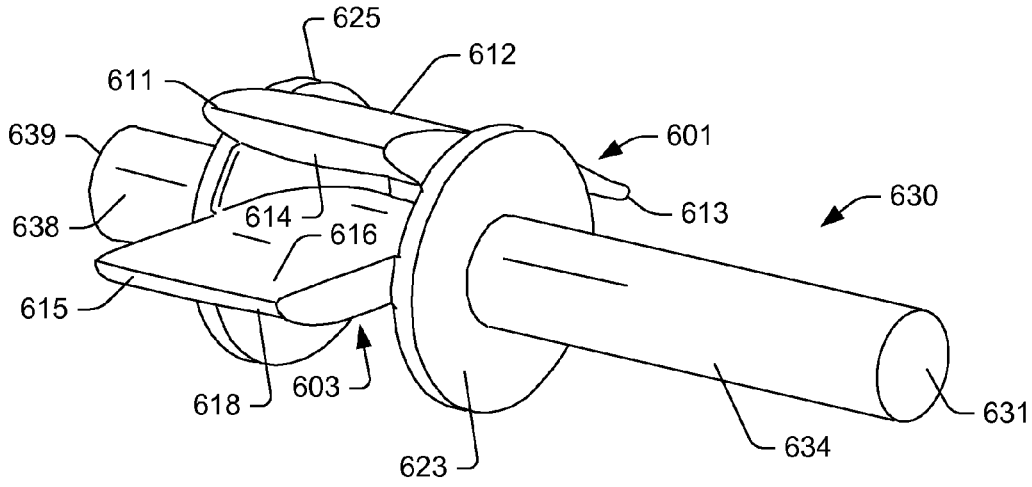
FIG. 6 is a series of views of a vane that includes multiple airfoils.
Figure 6:
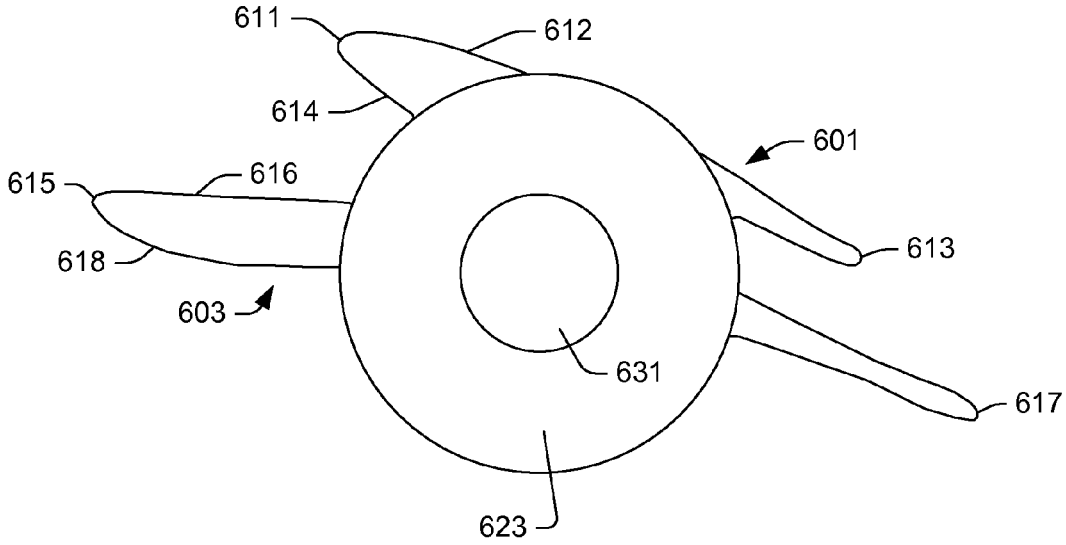

FIG. 6 shows an example of a vane 600 with multiple airfoils 601 and 603. In the example of FIG. 6, the vane 600 has a post 630 with a lower portion 634 and an upper portion 638 disposed between a base end 631 and a hub end 639. The vane 600 further includes a lower cylindrical plate 623 and an upper cylindrical plate 625. The airfoils 601 and 603 may be selected and affixed to the plates 623 and 625. Accordingly, generic post and supports may be provided for use with a variety of different airfoils. Alternatively, a vane may be cast as a single piece. In the example of FIG. 6, the airfoil 601 has airfoil surfaces 612 and 614 disposed between a leading edge 611 and a trailing edge 613 and the airfoil 603 has airfoil surfaces 616 and 618 disposed between a leading edge 615 and a trailing edge 617.

In the example of FIG. 6, the vane 600 includes a first airfoil 601 that includes a length between a leading edge 611 and a trailing edge 613; a second airfoil 603 that includes a length between a leading edge 615 and a trailing edge 617 (e.g., where the length of the first airfoil may differ from the length of the second airfoil); and an intra-vane throat defined at least in part by the first airfoil 601 and the second airfoil 603.

Figure 7:
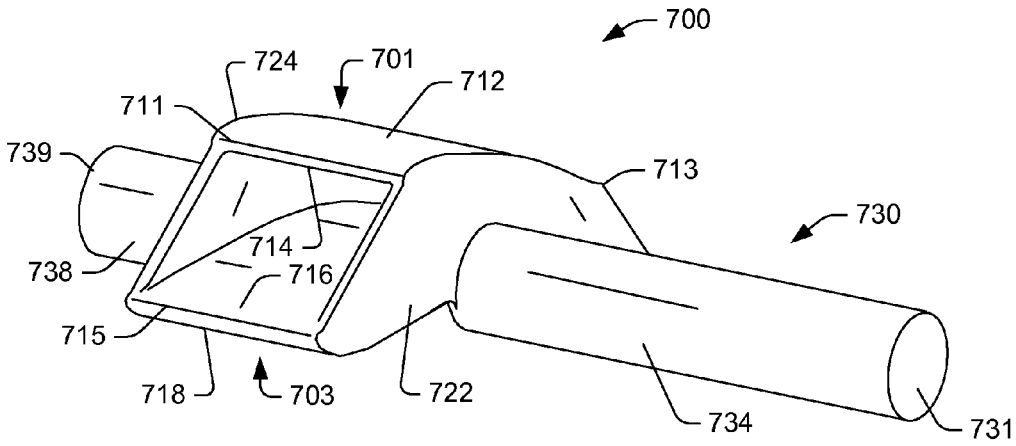
FIG. 7 is a series of views of a vane that includes multiple airfoils.
Figure 7:
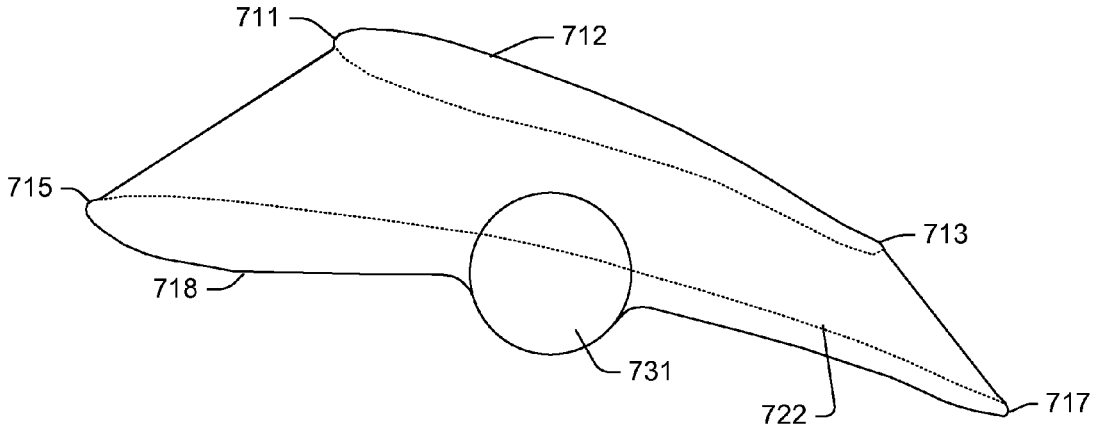

FIG. 7 shows an example of a vane 700 with multiple airfoils 701 and 703. In the example of FIG. 7, the vane 700 has a post 730 with a lower portion 734 and an upper portion 738 disposed between a base end 731 and a hub end 739. The vane 700 has a "box" shape formed in part by a lower 722 and an upper plate 724. The vane 700 may be cast as a single piece or otherwise formed or assembled. In the example of FIG. 7, the airfoil 701 has airfoil surfaces 712 and 714 disposed between a leading edge 711 and a trailing edge 713 and the airfoil 703 has airfoil surfaces 716 and 718 disposed between a leading edge 715 and a trailing edge 717. Inner facing surfaces of the lower plate 722 and the upper plate 724 may optionally be shaped to enhance performance.

In the example of FIG. 7, the vane 700 includes a first airfoil 701 that includes a length between a leading edge 711 and a trailing edge 713; a second airfoil 703 that includes a length between a leading edge 715 and a trailing edge 717 (e.g., where the length of the first airfoil may differ from the length of the second airfoil); and an intra-vane throat defined at least in part by the first airfoil 701 and the second airfoil 703.

Figure 8:
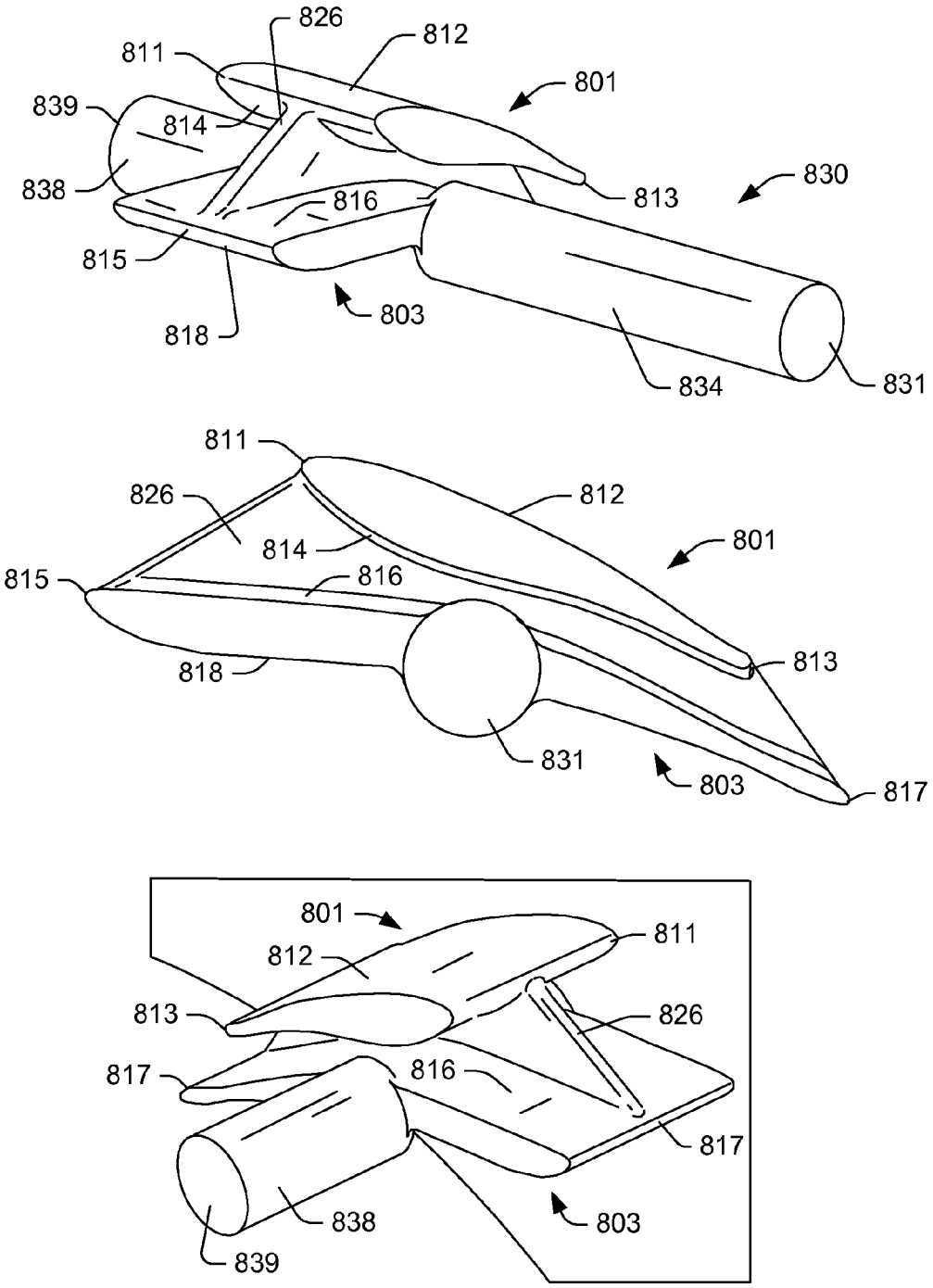
FIG. 8 is a series of views of a vane that includes multiple airfoils with multiple intra-vane throats.

FIG. 8 shows an example of a vane 800 with multiple airfoils 801 and 803. In the example of FIG. 8, the vane 800 has a post 830 with a lower portion 834 and an upper portion 838 disposed between a base end 831 and a hub end 839. The vane 800 has a connector 826 that extends between the two airfoils 801 and 803. The vane 800 may be cast as a single piece or otherwise formed or assembled. In the example of FIG. 8, the airfoil 801 has airfoil surfaces 812 and 814 disposed between a leading edge 811 and a trailing edge 813 and the airfoil 803 has airfoil surfaces 816 and 818 disposed between a leading edge 815 and a trailing edge 817. Surfaces of the connector 826 may optionally be shaped to enhance performance.

The vane 800 has two intra-vane throats, a hub side throat and a base side throat. While the intra-vane throats are shown as being essentially mirror images of each other, a vane with two airfoils and a connector may have throats that differ. For example, a lower throat may be shaped to enhance flow to a lower inducer portion of a turbine wheel while an upper throat may be shaped to enhance flow to an upper inducer portion of a turbine wheel. Further, while the example of FIG. 8 shows the connector 826 as being essentially planar and at a constant z position along the length of the vane 800, such a connector may optionally be shaped differently (e.g., to provide certain characteristics).

In the example of FIG. 8, the vane 800 includes a first airfoil 801 that includes a length between a leading edge 811 and a trailing edge 813; a second airfoil 803 that includes a length between a leading edge 815 and a trailing edge 817 (e.g., where the length of the first airfoil may differ from the length of the second airfoil); and multiple intra-vane throats defined at least in part by the first airfoil 801 and the second airfoil 803.

As described herein, one or more airfoils of a multiple airfoil vane may include a non-zero sweep angle, a non-zero lean angle, a non-zero twist angle or any combination thereof (e.g., to provide 3D variation of an airfoil along a z-axis). As described herein, one or more airfoils of a multiple airfoil vane may include 3D variations (e.g., length, width, etc.). As described herein, one or more airfoils of a multiple airfoil vane may include multiple anti-nodes along a camberline (e.g., consider an airfoil with three anti-nodes along a camberline).

As described herein, a method can include providing a plurality of multiple airfoil vanes where each vane includes at least one intra-vane throat and where adjacent vanes define inter-vane throats; and pivotably adjusting the plurality of vanes to alter only shape of the inter-vane throats. In such a method, closing the inter-vane throats by pivotably adjusting the plurality of vanes may effectively close the intra-vane throats. Such a method may further include providing a turbine wheel with improved efficiency, the improved efficiency resulting from turbine wheel blades configured for flow dynamics associated with the multiple airfoil vanes (e.g., where the vanes improve shock/wake characteristics of flow and allow for blades of lesser mass, thickness, etc.).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. A vane for a turbine assembly of a turbocharger, the vane comprising:
- a first airfoil that comprises a length between a leading edge and a trailing edge;
- a second airfoil that comprises a length between a leading edge and a trailing edge;
- one or more intra-vane throats defined at least in part by both the first airfoil and the second airfoil; and
- a post connected to the first airfoil and the second airfoil for pivoting the vane as a unit.

2. The vane of claim 1 wherein the vane comprises a single intra-vane throat.

3. The vane of claim1 wherein the vane comprises two intra-vane throats.

4. The vane of claim 3 further comprising a connector that connects the first airfoil and the second airfoil and separates the two intra-vane throats.

5. The vane of claim 1 wherein the post comprises a post axis and wherein one of the airfoils comprises an offset from the post axis.

6. The vane of claim 5 wherein the other airfoil is centered on the post axis.

7. The vane of claim 1 wherein the length of the first airfoil differs from the length of the second airfoil.

8. The vane of claim 1 wherein the airfoils comprise convex inner airfoil surfaces.

9. The vane of claim 8 wherein the convex inner airfoil surfaces define, at least in part, the one or more throats.

10. The vane of claim 1 wherein the airfoils comprise concave outer airfoil surfaces.

11. The vane of claim 1 comprising a connector that connects the first airfoil to the second airfoil and fixes position of the first airfoil with respect to position of the second airfoil to thereby fixedly shape the one or more intra-vane throats.

12. A variable nozzle turbine assembly comprising:
- a plurality of vanes that define inter-vane throats wherein each vane comprises
  - a first airfoil that comprises a length between a leading edge and a trailing edge;
  - a second airfoil that comprises a length between a leading edge and a trailing edge;
  - one or more intra-vane throats defined at least in part by the first airfoil and the second airfoil; and
  - an axel connected to the first airfoil and the second airfoil for pivoting the vane as a unit.

13. The variable nozzle turbine assembly of claim 12 wherein the length of the second airfoil exceeds the length of the first airfoil and wherein the trailing edges of the second airfoils define at least in part the inter-vane throats.

14. The variable nozzle turbine assembly of claim 12 wherein pivotable adjustment of the plurality of vanes alters shape of the inter-vane throats.

15. The variable nozzle turbine assembly of claim 12 further comprising an annular ring that comprises openings configured for receipt of the axels.

16. The variable nozzle turbine assembly of claim 12 further comprising a turbine wheel, the turbine wheel configured with blades to match the flow dynamics of the plurality of vanes.

17. The variable nozzle turbine assembly of claim 12 comprising a connector that connects the first airfoil to the second airfoil and fixes position of the first airfoil with respect to position of the second airfoil to thereby fixedly shape the one or more intra-vane throats.

18. A method comprising:
- providing a plurality of multiple airfoil vanes wherein each vane comprises at least one intra-vane throat and wherein adjacent vanes define inter-vane throats; and
- pivotably adjusting the plurality of vanes to alter only shape of the inter-vane throats wherein the pivotably adjusting comprises rotating a post connected to the multiple airfoils of each of the vanes to pivot each vane as a unit.

19. The method of claim 18 further comprising closing the inter-vane throats by pivotably adjusting the plurality of vanes wherein the closing effectively closes the intra-vane throats.

20. The method of claim 18 further comprising providing a turbine wheel with improved efficiency, the improved efficiency resulting from blades configured for flow dynamics associated with the multiple airfoil vanes.

21. The method of claim 18 wherein each vane comprises a connector that connects its multiple airfoils and fixes positions of its multiple airfoils with respect to each other to thereby fixedly shape its at least one intra-vane throat.

22. A vane for a turbine assembly of a turbocharger, the vane comprising:
- a first airfoil that comprises a length between a leading edge and a trailing edge;
- a second airfoil that comprises a length between a leading edge and a trailing edge; and
- two intra-vane throats defined at least in part by both the first airfoil and the second airfoil.

23. The vane of claim 22 further comprising a connector that connects the first airfoil and the second airfoil and separates the two intra-vane throats.

* * * * *